United States Patent [19]

Rohlin

[11] 3,945,656

[45] Mar. 23, 1976

[54] SKI BINDING

[76] Inventor: William F. Rohlin, 2119 Glencoe Hills Drive, Ann Arbor, Mich. 48104

[22] Filed: May 15, 1975

[21] Appl. No.: 577,642

[52] U.S. Cl. ..... 280/11.35 D; 280/11.35 R
[51] Int. Cl.[2] ..... A63C 9/086
[58] Field of Search 280/11.35 R, 11.35 K, 11.35 D, 280/11.35 C, 11.35 Y, 11.35 M

[56] References Cited

UNITED STATES PATENTS

| | | | |
|---|---|---|---|
| 3,210,090 | 10/1965 | Keeling et al. | 280/11.35 K |
| 3,359,009 | 12/1967 | Hinterholzer | 280/11.35 K |
| 3,606,368 | 9/1971 | Smolka et al. | 280/11.35 D |
| 3,727,932 | 4/1973 | Druss | 280/11.35 K |
| 3,772,802 | 11/1973 | Smolka et al. | 280/11.35 D |
| 3,865,388 | 2/1975 | Haldemann | 280/11.35 D |

*Primary Examiner*—M. H. Wood, Jr.
*Assistant Examiner*—David M. Mitchell
*Attorney, Agent, or Firm*—Olsen and Stephenson

[57] ABSTRACT

A ski binding and boot for down hill skiing which utilizes only a single release mechanism between the ski boot and the ski. The release mechanism is connected to the heel of the ski boot and to the ski and is operable to release either in response to applied forces causing twisting of the heel relative to the ski or in response to applied forces causing lifting of the heel from the ski. Adjustment means are provided for setting the magnitude of applied forces required to cause release, and manual release means are also provided.

7 Claims, 9 Drawing Figures

FIG. 1
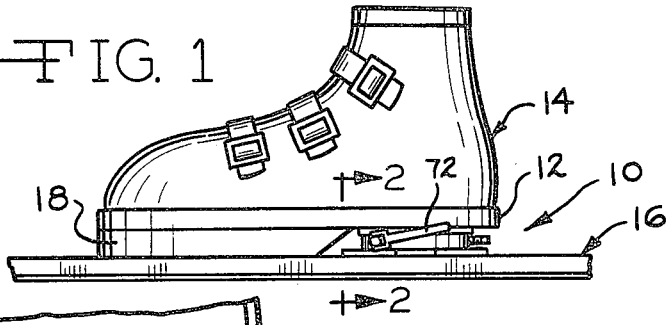
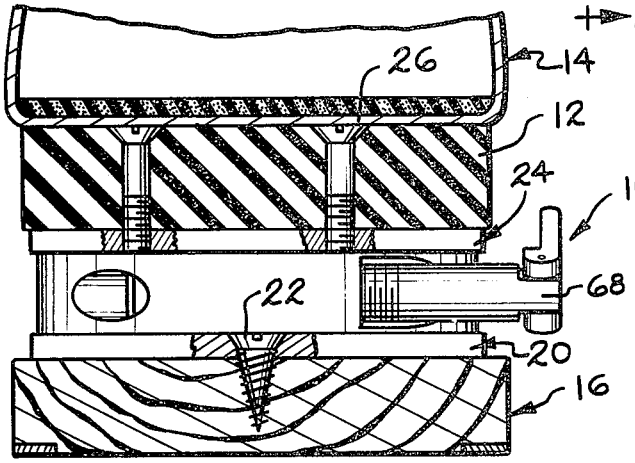
FIG. 2
FIG. 3
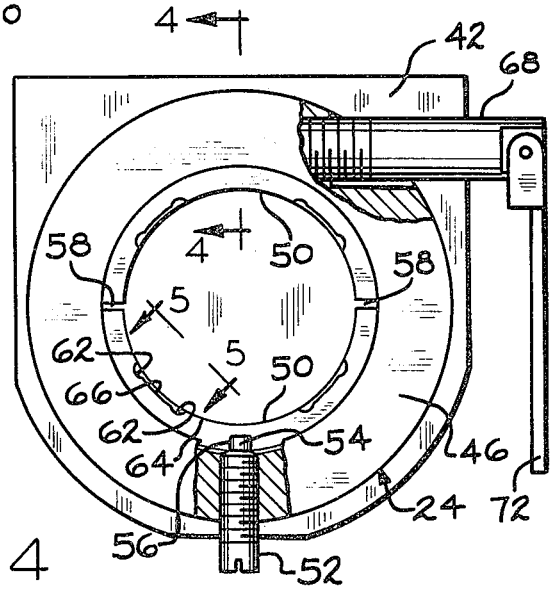
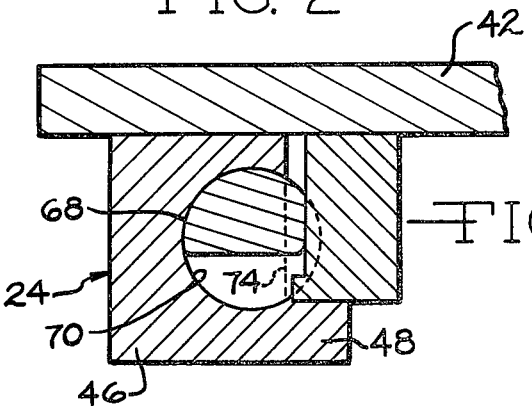
FIG. 4
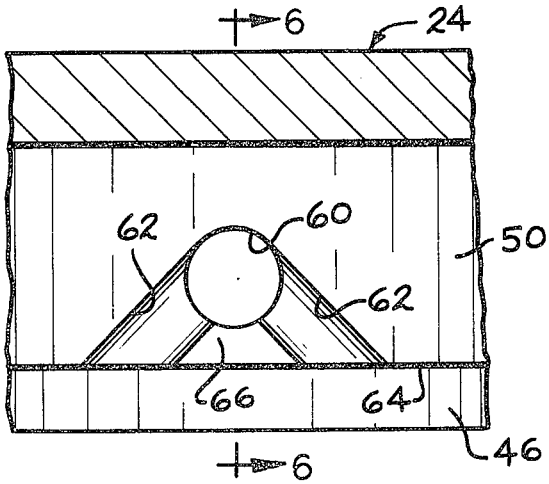
FIG. 5
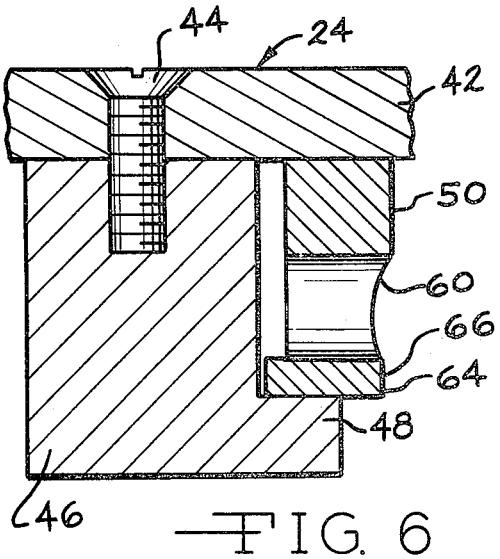
FIG. 6

SKI BINDING

BACKGROUND OF THE INVENTION

The present invention relates to a ski binding expecially adapted for down hill skiing.

It is known to provide ski bindings for down hill skiing that will release the ski boot from the ski in response to certain applied forces. Ski bindings of this character are intended to protect the skier from serious injuries during a fall.

It is conventional practice to provide ski bindings of the foregoing character which require release means for both the heel and the toe of the ski boot. Arrangements such as this do not always give the desired release action, in that there is no release for combined forces of twisting and lifting so that leg injuries to the skier frequently occur. Some efforts have been made to utilize a single release mechanism between the ski and the boot but without complete success for release in all angles above the plane of the ski.

SUMMARY OF THE INVENTION

The present invention has overcome the inadequacies of the prior art, and provides an improved ski binding which utilizes only a single release mechanism located between the ski and the heel of the ski boot.

According to a preferred form of the present invention a ski binding is provided comprising a heel release mechanism including a base member adapted for attachment to a ski, and an upper member releasably connected to the base member and adapted for attachment to the heel of a ski boot, the base member and the upper member having cooperating detent means for holding them together, the detent means being releasably in response to applied forces causing relative twisting of said members about a vertical axis and in response to applied forces causing relative upward movement of said upper member with respect to said base member..In addition, the release mechanism responds to applied combined forces of twisting and lifting. The magnitude of the holding action of the detent means can be selectively adjusted, and manual means are provided to release the detent means partially when it is desired to remove the ski boot from the ski.

Thus, an improved ski binding has been provided which has a single release mechanism between the ski and the heel of the boot, the mechanism being operable to release when forces above selected magnitudes occur that tend to twist or to uplift the boot relative to the ski.

Other objects of this invention will appear in the following description and appended claims, reference being had to the accompanying drawings forming a part of this specification wherein like reference characters designate corresponding parts in the several views.

BRIEF DESCRIPTION OF THE DRAWINGS

FIG. 1 is a fragmentary side elevational view of a ski and ski boot with a ski binding embodying the present invention;

FIG. 2 is an enlarged sectional view taken on the lines 2—2 of FIG. 1;

FIG. 3 is a bottom plan view of the upper member of the ski binding;

FIG. 4 is an enlarged fragmentary section taken on the lines 4—4 of FIG. 3;

FIG. 5 is an elevational view, partially in section viewed in the direction of the lines 5—5 of FIG. 3;

FIG. 6 is a fragmentary section taken on the lines 6—6 of FIG. 5;

DESCRIPTION OF A PREFERRED EMBODIMENT

Figure 8:
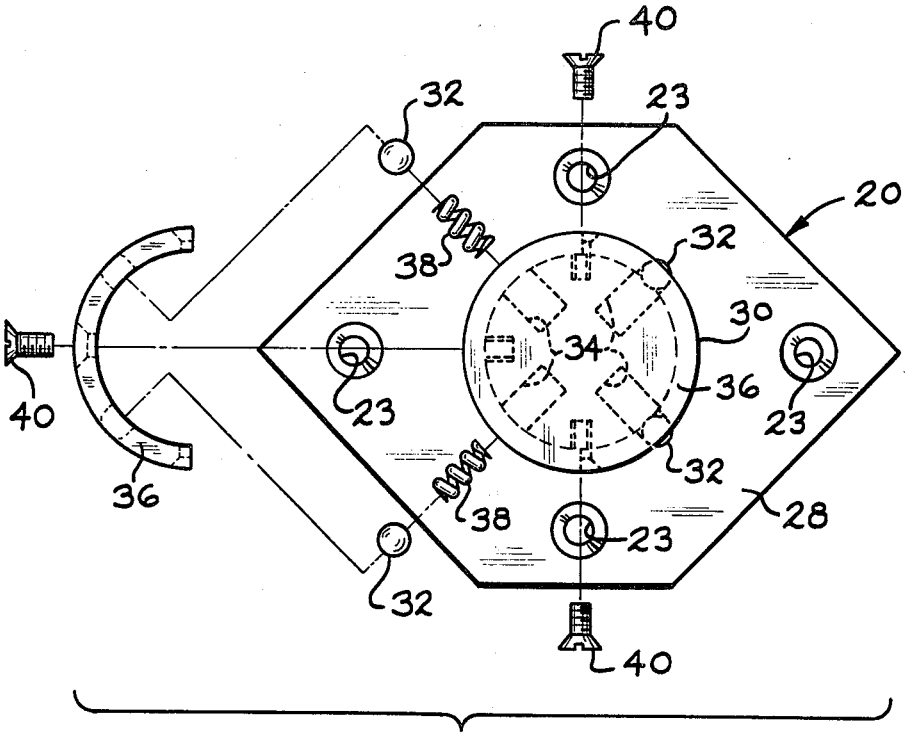
FIG. 8 is a partially exploded top plan view of the base member.

Before explaining the present invention in detail, it is to be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

Referring now to the drawings, the invention will be described in greater detail. The ski binding 10 is a heel release mechanism and comprises the only connection between the heel 12 of the ski boot 14 and the ski 16. As can be seen in FIG. 1, the sole 18 of the ski boot 14 merely rests on the top surface of the ski 16.

The ski binding or heel release mechanism 10 includes the base member 20, secured to the ski 16 by a plurality of screws 22 extending through countersunk bores 23, and the upper member 24 secured to the heel 12 by a plurality of screws 26. The base member 20 and the upper member 24 are releasably connected together.

Figure 7:
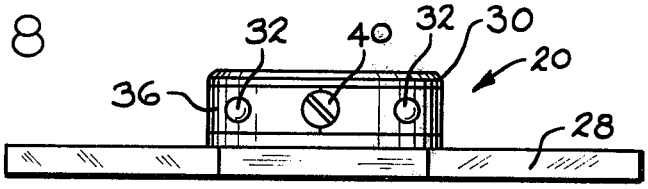
FIG. 7 is a rear elevational view of the base member of the ski binding mounted on the ski.
Figure 9:
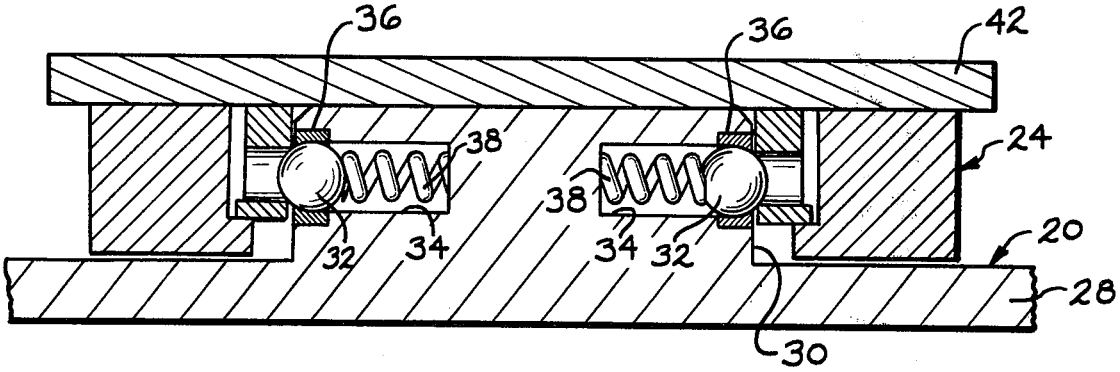
FIG. 9 is an enlarged vertical section through the ski binding illustrating details of the release mechanism.

The base member 20 includes the base plate 28 which has a vertical post 30 extending upward therefrom. The vertical post 30 has a plurality of radially directed spring actuated balls 32 projecting from its outer periphery. This arrangement can be seen best in FIGS. 7–9, inclusive, wherein the balls 32 are shown retained in the radial bores 34 by the retainer ring segments 36 and maintained in a spring-loaded condition by the compression springs 38. The retainer ring segments 36 are secured in place by a plurality of screws 40.

The upper member 24 includes the heel plate 42 to which is secured by screws 44 the collar 46. The latter has an inwardly directed retaining lip or flange 48 which retains the split ring or annulus 50 which has two segments that are free to float to a limited extent within the confines of the heel plate 42 and the retaining lip 48. The annulus 50 is retained against rotation relative to the collar 46 by the adjustment or set screw 52 which is threadedly connected to the collar 46 and has a projection 54 on its inner end that projects into the notch 56 in annulus 50 restraining the latter from relative rotation. The adjustment or set screw 52 also serves as an adjustment means for the release mechanism, as will be described, in that the screw 52 can be advanced or retracted to vary the size of the one or more radial slots 58 between the segments of annulus 50. Contraction or enlargement of the one or more radial slots 58 will correspondingly change the effective diameter of annulus 50 for a purpose to be described.

The annulus 50 has on its inner surface a plurality of sockets 60, corresponding in number and circumferential spacing to the balls 32 in the vertical post 30. Associated with each socket 60 are grooves 62 that are angularly disposed from the sockets 60 to the edge 64. Also associated with each socket 60 is the V-shaped land 66 between the associated grooves 62 which is recessed a limited distance into the inner surface of the annulus 50.

The sockets 60 are arranged to receive the balls 32 and to function therewith as a detent means for holding the upper member 24 in a fixed position on the base member 20. When in this position, the grooves 62 form paths of less resistance to allow the spring actuated balls 32 to be constructed and then to roll therein when relative twisting or turning occurs between the members 20 and 24. Thus, a release is provided in response to applied forces that would tend to twist the leg of the skier relative to the ski.

The lands 66 also serve to provide a release of the detent means in response to applied forces which tend to move the upper member 24 generally in an axial direction of the annulus 50 relative to the post 30. Thus, a release is provided in response to applied forces resulting when the skier falls and exerts an uplift of the heel relative to the ski. It will be noted that the grooves 62 are recessed deeper than the lands 66 so that the release means will release more readily in response to twisting action than an uplift of the heel 12 relative to the ski 16.

The lands 66 are sloped inward to the grooves 62 to provide for release when a combined forces of twisting and lifting are applied to the upper member 24.

As previously indicated, the adjustment or set screw 52 can be adjusted to set the spacing at 58 so that the detent means will release when the applied forces tending to twist the leg of the skier are at a sufficiently low level to protect the skier from injury.

The ski binding 10 can readily be released when the skier desires to remove his ski boot 14 from the ski 16. For this purpose the upper member 24 includes a cam shaft 68 mounted for turning in the bore 70 in the collar 46. The cam shaft includes a pivotally mounted lever 72 for turning the cam shaft 68 between the solid line position shown in the drawings when the slots 58 are relatively small and the broken line position, shown at 74 in FIG. 4, which allows the slots 58 to become larger and thereby reduce the applied forces necessary to release the detent means.

It is claimed:

1. A ski binding comprising a heel release mechanism including a base member adapted for attachment to a ski, and an upper member releasably connected to said base member and adapted for attachment to the heel of a ski boot, said base member and said upper member having cooperating detent means including a plurality of spring actuated balls and a plurality of associated sockets for holding the members together, said detent means being releasable in response to applied forces causing relative turning of said members about a vertical axis and in response to applied forces causing relative movement of said upper member from said base member in a generally vertical direction, one of said members defining a vertical post which has projecting radially from around its periphery said spring actuated balls, and the other of said members defining an annulus telescoped over said post, said annulus having around its inner periphery said plurality of sockets in which said balls are received for holding the annulus on the post, said annulus having grooves on its inner periphery of lesser radial depth than said sockets and angularly disposed from said sockets to an edge of said annulus through which said balls can travel when relative turning of said members occurs, said grooves being angularly disposed in both directions from each socket so as to provide a V-shaped land in an axial direction from each socket, each said land being recessed in the inner periphery of the annulus to facilitate release of said upper member from said base member in a generally vertical direction.

2. The ski binding that is defined in claim 1, wherein said detent means are adjustable for varying the magnitude of the applied forces required to cause release of the upper member from the base member.

3. The ski binding that is defined in claim 1, wherein a manually actuable release means is provided in association with said detent means for movement to a first position in which said detent means release at a relatively low magnitude of applied forces and a second position in which said detent means release at a relatively high magnitude of applied forces.

4. The ski binding that is defined in claim 1, wherein said detent means are adjustable for varying the magnitude of the applied forces required to cause release of the upper member from the base member, and a manually actuable release means is provided in association with said detent means for movement to a first position in which said detent means release at a relatively low magnitude of applied forces and a second position in which said detent means release at a relatively higher magnitude of applied forces.

5. In combination, the ski binding that is defined in claim 1, and a ski boot having a heel, said heel being rigidly affixed to the upper portion of said upper member.

6. A ski binding comprising a heel release mechanism including a base member adapted for attachment to a ski, and an upper member releasably connected to said base member and adapted for attachment to the heel of a ski boot, said base member and said upper member having cooperating detent means for holding them together, said detent means being releasable in response to applied forces causing relative turning of said members about a vertical axis and in response to applied forces causing relative movement of said upper member from said base member in a generally vertical direction, one of said members defining a vertical post which has projecting from around its periphery a plurality of radially directed spring actuated balls, and the other of said members defining an annulus telescoped over said post, said annulus having around its inner periphery a plurality of sockets in which said balls are received for holding the annulus on the post, said annulus having at least one radial slot for allowing radial expansion and contraction thereof, and a cam shaft mounted in said other member and having a cam in engagement with said annulus so that when the cam is in a second position the annulus is contracted and when in a first position the annulus can expand, said cam shaft having thereon a lever for manually moving the cam between its first and second positions to facilitate the holding of or the manual disengagement of the ski with respect to the heel.

7. The ski binding that is defined in claim 6, wherein a set screw is threadedly secured in said other member and abuts the outer periphery of said annulus for contracting or expanding of the annulus in response to turning of said set screw.

* * * * *